US011062581B2

(12) United States Patent
Merkel et al.

(10) Patent No.: US 11,062,581 B2
(45) Date of Patent: Jul. 13, 2021

(54) MODIFICATION OF RESPONSES TO ROBOT DETECTIONS

(71) Applicant: Hewlett-Packard Development Company, L.P., Spring, TX (US)

(72) Inventors: Harold Merkel, Houston, TX (US); Will Allen, Corvallis, OR (US); Tyler Sims, Corvallis, OR (US); James M Mann, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/627,411

(22) PCT Filed: Oct. 23, 2017

(86) PCT No.: PCT/US2017/057818
§ 371 (c)(1),
(2) Date: Dec. 30, 2019

(87) PCT Pub. No.: WO2019/083494
PCT Pub. Date: May 2, 2019

(65) Prior Publication Data
US 2020/0250947 A1 Aug. 6, 2020

(51) Int. Cl.
*G08B 13/00* (2006.01)
*G08B 13/22* (2006.01)
*G08B 29/18* (2006.01)

(52) U.S. Cl.
CPC ..... *G08B 13/22* (2013.01); *G08B 29/185* (2013.01)

(58) Field of Classification Search
CPC ..... G08B 13/22; G08B 29/185
USPC ..... 340/541
See application file for complete search history.

(56) References Cited

U.S. PATENT DOCUMENTS

| | | | | |
|---|---|---|---|---|
| 7,750,803 | B2 | 7/2010 | Matsuhira et al. | |
| 9,984,558 | B2 * | 5/2018 | Artes | G08B 13/18 |
| 10,012,996 | B1 * | 7/2018 | Canoso | G05D 1/0274 |
| 10,723,018 | B2 * | 7/2020 | Griffin | A47L 9/2889 |
| 10,728,505 | B2 * | 7/2020 | Sue | G05B 23/0208 |
| 2009/0303042 | A1 * | 12/2009 | Song | G08B 13/19647 340/566 |
| 2012/0254624 | A1 * | 10/2012 | Malkhasyan | G06F 21/572 713/189 |
| 2012/0313779 | A1 | 12/2012 | Papaefstathiou et al. | |
| 2015/0170509 | A1 * | 6/2015 | Artes | G08B 13/18 340/501 |

(Continued)

FOREIGN PATENT DOCUMENTS

CN 1753040 A 3/2006

OTHER PUBLICATIONS

Sales, D.O., et al. "Multi-agent autonomous patrolling system using ANN and FSM control." In 2012 Second Brazilian Conference on Critical Embedded Systems, pp. 48-53. IEEE, 2012.

(Continued)

*Primary Examiner* — Zhen Y Wu
(74) *Attorney, Agent, or Firm* — Tong Rea Bentley & Kim LLC

(57) ABSTRACT

In example implementations, a method is provided. The method may be executed by a processor of a security system. The method includes detecting a robot. The robot may then be validated. The response of the security system may be modified in response to the robot that is detected and validated.

8 Claims, 4 Drawing Sheets

(56) References Cited

U.S. PATENT DOCUMENTS

| | | | | |
|---|---|---|---|---|
| 2015/0283702 | A1* | 10/2015 | Izhikevich | G05D 1/0022 700/257 |
| 2016/0188977 | A1* | 6/2016 | Kearns | G05D 1/0274 348/113 |
| 2016/0266577 | A1 | 9/2016 | Kerzner | |
| 2016/0371961 | A1 | 12/2016 | Narang et al. | |
| 2017/0225334 | A1 | 8/2017 | Deyle et al. | |
| 2017/0246739 | A1* | 8/2017 | Frisby | B25J 11/008 |
| 2017/0361468 | A1* | 12/2017 | Cheuvront | G06F 16/00 |
| 2018/0012460 | A1* | 1/2018 | Heitz, III | G08B 13/19684 |
| 2018/0061220 | A1* | 3/2018 | Greene | G06K 9/00771 |
| 2018/0147721 | A1* | 5/2018 | Griffin | A47L 11/4011 |

OTHER PUBLICATIONS

Venkatadri, B. et al., Design of User Friendly Human Alive Detection Robot to Avoid False Alarm and to Tackle Crisis Situation, Jun. 13, 2015, http://www.warse.org/ijeter/static/pdf/Issue/NCTET2015sp36.pdf.

* cited by examiner

302

EVENT RECORDS

| TIME | EVENT | LOCATION |
|---|---|---|
| 01:52 | STATUS CHECK | A1-$304_1$ |
| 01:56 | MOTION DETECTED | B2-$304_2$ |
| 01:57 | ALARM INITIATED | B2-$304_3$ |
| 02:01 | ACCESS GRANTED | A3-$304_4$ |
| 02:04 | MOTION DETECTED | B1-$304_5$ |
| 02:04 | ALARM INITIATED | B1-$304_6$ |
| 02:05 | ALARM CLEARED | B1-$304_n$ |

304

EVENT RECORDS

| TIME | EVENT | LOCATION |
|---|---|---|
| 01:52 | STATUS CHECK | A1-$304_1$ |
| 02:01 | ACCESS GRANTED | A3-$304_4$ |
| 02:04 | MOTION DETECTED | B1-$304_5$ |
| 02:04 | ALARM INITIATED | B1-$304_6$ |
| 02:05 | ALARM CLEARED | B1-$304_n$ |

MODIFICATION OF RESPONSES TO ROBOT DETECTIONS

BACKGROUND

Alarm systems are used on premises to protect the premises and deter intrusions. The type of alarm system can vary. For example, some alarm systems may use sensors that can detect motion. When motion is detected by the sensor, the sensor may send a signal to a main controller that can trigger an alarm or notify security personnel. Status reports of the alarm system may record the motion detection to indicate that motion was detected. The status report may include a date, a time, a location, and the like of the motion detection.

DETAILED DESCRIPTION

Examples described herein provide an apparatus and a method for modifying responses of a security system to robot detections. As discussed above, alarm systems can use motion sensors to detect motion in a room. When the alarm systems are activated and a motion sensor detects motion, an alarm may be generated.

However, in some instances some motion may trigger a false alarm. For example, robots may be used in certain locations or rooms for a variety of different reasons. The robots may be cleaning, making deliveries, and the like, after hours when the security system or alarm system is activated. Activation of the alarms in response to constant detection of the robots' movement may be undesirable.

Examples described herein provide a method to validate a robot's presence when detected by a security system. The validation may include a one-time pad, a signal, a pre-defined motion pattern, and the like. When the robot is validated, the security system's response to the detection of the validated robot may be modified. For example, the security system may avoid alarming, the recording or reporting of events may be changed to remove the detection of the validated robot, access to another area that may otherwise be locked may be granted to the validated robot, and the like.

Figure 1:
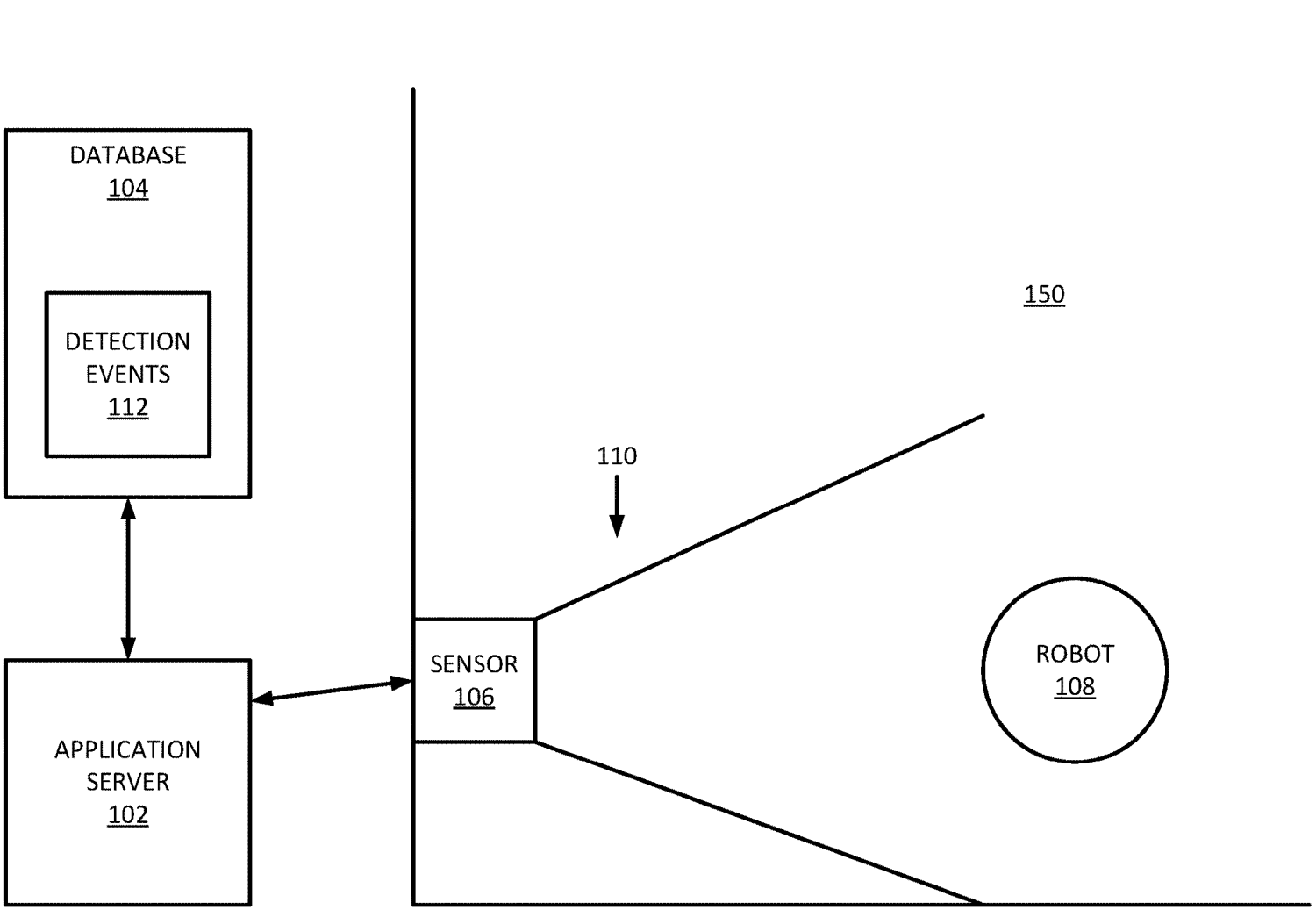
FIG. 1 is a block diagram of an example security system of the present disclosure.

FIG. 1 illustrates a block diagram of an example security system 100 of the present disclosure. The security system 100 may monitor a location 150. The location 150 may be a room, an environment, a particular area, a virtually defined area within a large room, and the like.

In one example, the security system 100 may include an application server 102, a database 104 and a sensor 106. In one example, the application server 102 may be communicatively coupled to the database 104 and the sensor 106 via a wired or wireless connection. In one example, the application server 102 may include a processor and a non-transitory computer readable storage medium that stores instructions that are executed by the processor. The application server 102 may control operations of the security system 100 (e.g., generating alarms, recording event data, controlling access to and from the location 150, and the like) and operation of the sensor 106.

In one example, the event data may be stored as detection events 112 in the database 104. The detection events 112 may include event records that are continuously generated by the application server 102 while the security system 100 is activated. The detection events 112 may include event records from the sensor 106 or any other sensor, access device, monitoring device, and the like that may be located in the location 150.

It should be noted that the application server 102 may be communicatively coupled to other sensors in other locations that are not shown. For example, a network of sensors may be deployed through different locations in a building, campus, environment, and the like. The application server 102 may control the operation of the network of sensors.

In one example, the sensor 106 may be motion sensor, a video camera, or any other type of sensor. It should be noted that although a single sensor 106 is illustrated in FIG. 1, any number of sensors 106 may be deployed within the location 150 or throughout a network of sensors, as noted above.

The sensor 106 may have a field of view 110. In one example, a robot 108 may enter the field of view 110 of the sensor 106. The robot 108 may be any type of automated machine or artificial intelligence that may be mobile and operate within the location 150. For example, the robot 108 may be a vacuum robot, a delivery robot, and the like.

When the robot 108 moves into the field of view 110, the sensor 106 may detect the motion of the robot 108. The sensor 106 may transmit a signal to the application server 102 indicating that motion has been detected and an event record may be generated that reflects the detected motion.

In one example, the application server 102 may attempt to establish a two-way communication path with the robot 108 to determine that the motion is caused by a robot and to perform a validation with the robot. For example, if the attempt to establish the two-way communication path fails, the application server 102 may determine that the motion is caused by a human and not a machine and immediately generate an alarm. The alarm may be an audible alarm, a silent alarm, a notification to security personnel, locking any doors to prevent the intruder from leaving until authorities arrive, and the like.

Other implementations may also be deployed to determine that the motion is caused by a robot and not a human. For example, additional sensors may be used to detect robots below a height threshold, a receiver may monitor for passive signals transmitted by robots, and the like.

Figures 2, 3:
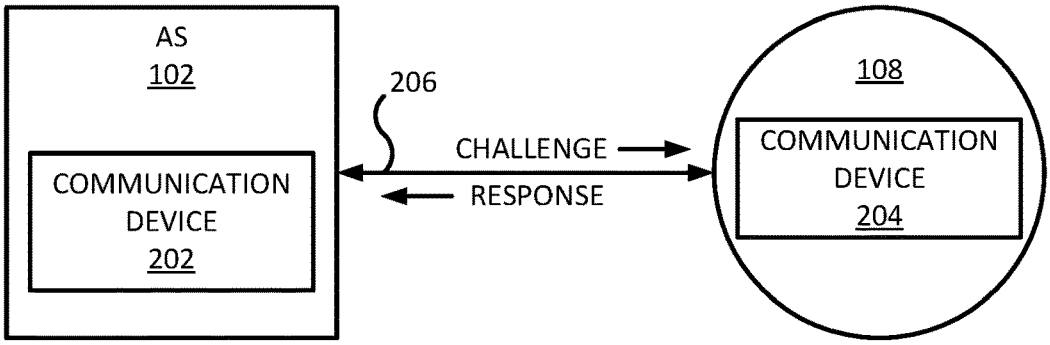
FIG. 2 is a block diagram of an example two-way communication path between an application server of the security system and a robot of the present disclosure.
FIG. 3 illustrates an example event record and modified event record of the present disclosure.

FIG. 2 illustrates an example of a two-way communication path 206 established between the application server 102 and the robot 108. In one example, the application server 102 may include a communication device 202 and the robot 108 may include a communication device 204. The communication device 202 and the communication device 204 may be Wi-Fi communication interfaces, cellular communication radios, Bluetooth radios, and the like.

In one example, once the two-way communication path 206 is established, the application server 102 may issue a challenge to the robot 108 to perform validation of the robot 108. The robot 108 may then transmit a response to the challenge. The database 104 may store pre-defined responses for robots 108 that are authorized.

Examples of the challenge and response used for validation by the application server 102 may include a request for a unique wireless signal (e.g., electronic signal or a light signal) of a particular frequency, a particular sequence of signals within a particular time period, a one-time pad (e.g., a challenge and password response), or a pre-defined motion pattern. The response may be compared to the pre-defined responses stored in the database 104. If a match is found, the robot 108 may be validated for the location 150. However, if a match is not found, the application server 102 may generate an alarm.

In one example, the pre-defined motion pattern may include a series of pre-defined movements that are known by authorized robots 108. For example, the pre-defined movement may be to rotate counter clockwise, then move five paces to the right, and then five paces forward.

Another example of the pre-defined movement may be to move to a particular area or coordinate in the location 150. For example, the pre-defined movement may be to move to the northwest corner of a room exactly 5 feet from both the north wall and the west wall.

Another example of the pre-defined movement may be a particular path the robot 108 takes to get to the particular area or coordinate in the location 150. For example, the location may be the northwest corner of the room and the robot 108 may move first towards a south wall within 5 feet of the wall and travel in a counter-clockwise direction towards the northwest corner.

As the robot 108 may transmit signals to the application server 102 indicating the movements of the robot 108 as the robot 108 performs the pre-defined movements in response to the challenge. The movements can be compared to the pre-defined responses or movements to validate the robot 108.

In one example, if the robot 108 is not validated (e.g., the two-way communication path 206 cannot be established or the response to the challenge is incorrect), the robot 108 maybe deemed to be an intruder. For example, the robot 108 may be introduced by a nefarious actor or the robot 108 may have been hacked remotely.

The application server 102 may take action in response to the invalid robot. For example, the application server 102 may trigger an audible alarm, send a notification to security personnel (e.g., via an email, via a text message, via a telephone call, and the like), lock doors to keep the invalid robot in the location 150 until security personnel arrive, and the like.

In one example, if the robot 108 is validated, then the application server 102 may modify a response to the detection of the robot 108. In one example, the application server 102 may suppress any alarm that would otherwise be triggered in response to movement that is detected by the sensor 106. In another example, the application server 102 may modify event records that were generated and stored in the database 104.

FIG. 3 illustrates an example of an event record 302 and a modified event record 304. The event record 302 may record various detection events $\mathbf{304}_1$ to $\mathbf{304}_n$ (hereinafter also referred to individually as a detection event 304 or collectively as detection events 304) that occur at different locations. The event record 302 may include a time, a description of the event, and a location. It should be noted that other types of information may be included in the event record 302.

In one example, as soon as the robot 108 enters the field of view 110 of the sensor 106, the detection events may be recorded in the event record 302. For example, the detection events $\mathbf{304}_2$ and $\mathbf{304}_3$ may be recorded in the event record 302 in response to the robot 108 being detected by the sensor 106. The application server 102 may initiate an alarm in response to the motion that is detected.

In one example, the robot 108 may be validated as described above over the two-way communication path 206. If the robot 108 is validated, the application server 102 may modify the event record 302 to generate a modified event record 304. For example, the detection events $\mathbf{304}_2$ and $\mathbf{304}_3$ may be removed, or deleted, from the event record 302. In the modified event record 304, the detection events $\mathbf{304}_2$ and $\mathbf{304}_3$ do not appear. As a result, the validation of the robot 108 may appear on the modified event record 304 as if the robot 108 was never in the location 150.

As a result, the security system 100 may not "see" good or validated robots 108. Less data may be processed by removing the detection events $\mathbf{304}_2$ and $\mathbf{304}_3$ for validated robots that are detected. In addition, the security system 100 may reduce false alarms when valid robots 108 enter the location 150.

In one example, modifying the response of the security system 100 in response to the detected and validated robot 108 may include changing an access in the location 150 that is available to the robot 108. For example, the security system 100 may normally lock the doors in response to detecting motion. However, if the robot 108 is validated, the application server 102 may unlock a door or a passageway for the robot 108. The robot 108 may then move through the unlocked door or passageway to the next location or environment. In another example, the access may be allow the robot 108 to select any floor in an elevator.

In another example, modifying the response of the security system 100 in response to the detected and validated robot 108 may include allowing the robot 108 to access devices within the location 150. For example, the location 150 may be a meeting room. The robot 108 that is validated may then be allowed to turn on a projector, establish communication paths to remote participants via a conference bridge device or telephone, turn on lights in the location 150, and the like.

Thus, the present disclosure provides a security system that can modify responses to detected robots. The modifications may make it appear as though the sensors do not "see" good robots. In other words, the response to robots that have entered, or are within, a field of view of a sensor can be modified as if the sensor did not see the robot within its field of view.

Figure 4:
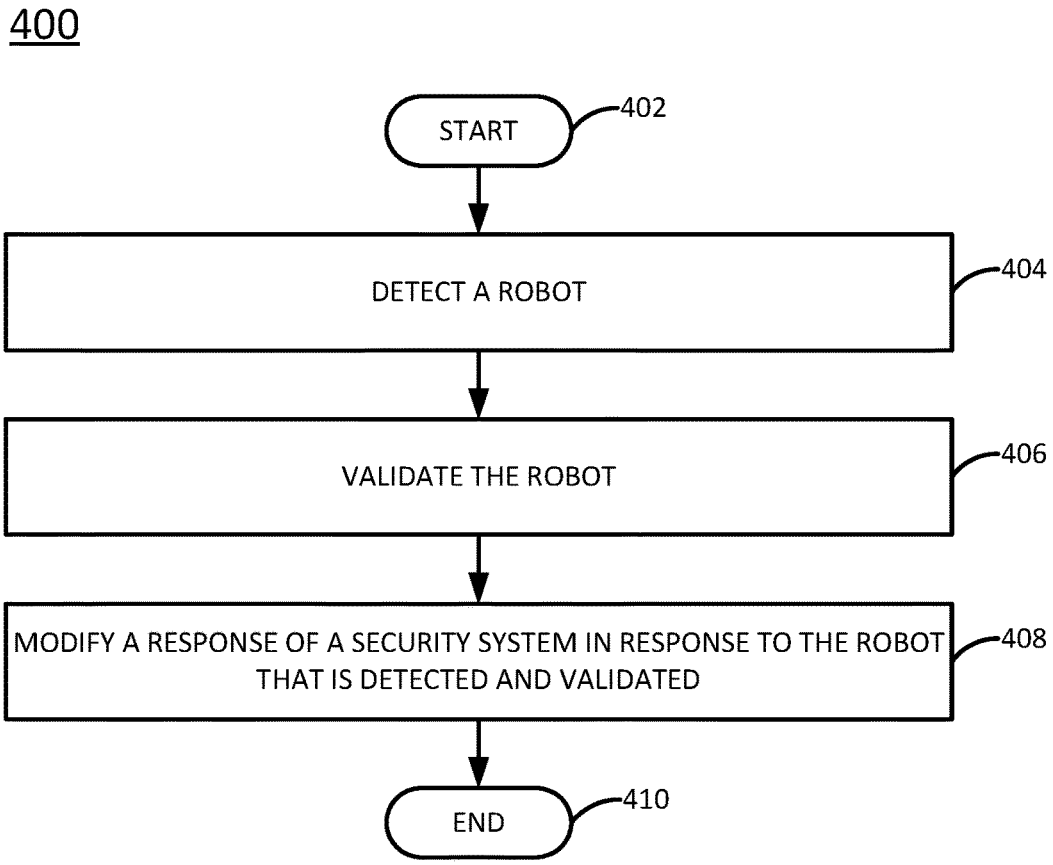
FIG. 4 is a flow chart of an example method for modifying a response of a security system in response to a robot that is detected and validated.

FIG. 4 illustrates a flow diagram of an example method 400 for modifying a response of a security system in response to a robot that is detected and validated. In one example, the method 400 may be performed by the application server 102.

At block 402, the method 400 begins. At block 404, the method 400 detects a robot. For example, a sensor of the security system within a location may detect motion. In response, an application server of the security system may attempt to establish a two-way communication path with the robot. The two-way communication path may be any type of wireless communication path (e.g., a Wi-Fi connection, a cellular connection, a Bluetooth connection, and the like).

If the two-way communication path is successfully established, the security system may know that the motion is caused by a robot. Other methods for detecting robots may also be used such as, for example, cameras that analyze objects below a particular height threshold, temperature sensors that scan a temperature of the object, video cameras, and the like.

At block 406, the method 400 validates the robot. In one example, after the robot is detected and the two-way communication path is established, the security system may perform validation via a challenge and challenge response interaction. For example, the challenge may request a particular signal, a sequence of signals, a one-time pad, a pre-defined motion, and the like.

The challenge response to the challenge may be received by the security system. The challenge response may be compared to pre-defined validation responses stored in a database. If a match is found, the robot may be validated.

At block 408, the method 400 modifies a response of the security system in response to the robot that is detected and validated. For example, the security system may modify an event record to delete, or remove, description events that were recorded in response to the robot that was detected. For example, a modified event record may be generated that makes it appear as if the robot was not "seen" by the sensor of the security system.

In other examples, the response of the security system may be modified to suppress an alarm (e.g., turn off an alarm or recall notification messages that may have been transmitted). In another example, the response of the security system may be modified to change an access in the environment that is available to the robot. For example, doors may be unlocked to allow the robot to access an adjacent room, granting access to communicate and/or activate other devices in the location, and the like. At block 410, the method 400 ends.

Figure 5:
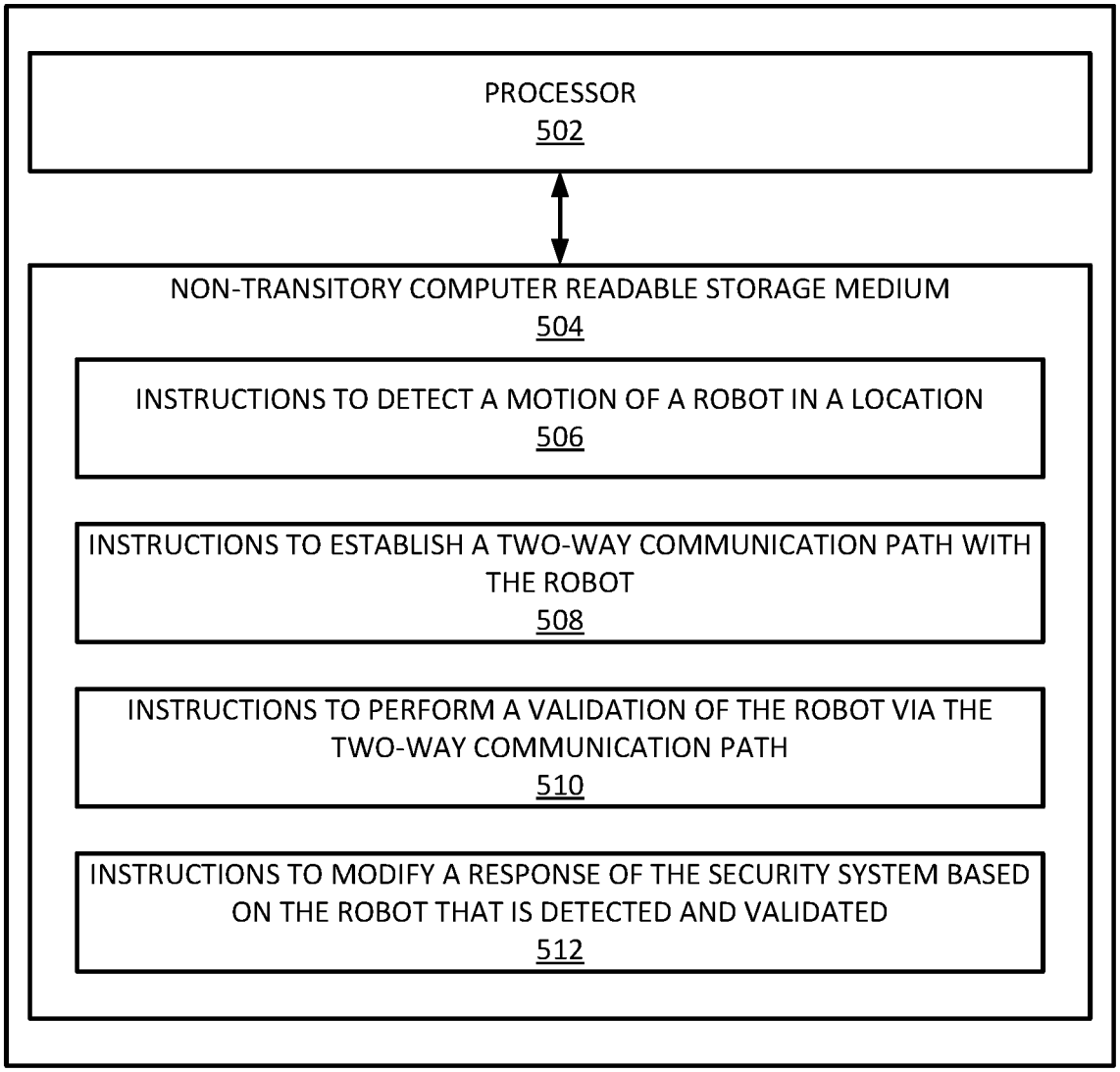
FIG. 5 is a block diagram of an example non-transitory computer readable storage medium storing instructions executed by a processor.

FIG. 5 illustrates an example of an apparatus 500. In one example, the apparatus 500 may be the application server 102. In one example, the apparatus 500 may include a processor 502 and a non-transitory computer readable storage medium 504. The non-transitory computer readable storage medium 504 may include instructions 506, 508, 510, and 512 that, when executed by the processor 502, cause the processor 502 to perform various functions.

In one example, the instructions 506 may include instructions to detect a motion of a robot in a location. The instructions 508 may include instructions to establish a two-way communication path with the robot. The instructions 510 may include instructions to perform a validation of the robot via the two-way communication path. The instructions 512 may include instructions to modify a response of the security system based on the robot that is detected and validated.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A method, comprising:

receiving, by a processor of the security system, a detection signal from a sensor that detects motion of a robot;

establishing, by the processor, a two-way communication between the processor and the robot;

issuing, by the processor, a challenge to the robot:

validating, by the processor, the robot based on a pre-defined motion pattern performed by the robot in response to the challenge: and modifying, by the processor, a response of the security system in response to the robot that is detected and validated, wherein the modifying comprises removing a detection event that is generated during the detecting from an event record, wherein the detection event includes a time, a description of the detection event, and a location.

2. The method of claim 1, wherein the validating comprises a two-way communication between the processor and the robot.

3. The method of claim 1, wherein the modifying comprises suppressing an alarm that is generated in response to the detecting.

4. The method of claim 1, wherein the modifying comprises changing an access in an environment that is available to the robot.

5. A non-transitory computer readable storage medium encoded with instructions executable by a processor, the non-transitory computer-readable storage medium comprising:

instructions to detect a motion of a robot in a location by a sensor;

instructions to establish a two-way communication path with the robot;

instructions to issue a challenge to the robot;

instructions to perform a validation of the robot via the two-way communication path based on a pre-defined motion pattern performed by the robot in response to the challenge; and instructions to modify a response of the security system based on the robot that is detected and validated, wherein the instructions to modify comprise removing a detection event that is generated during the detecting from an event record, wherein the detection event includes a time, a description of the detection event, and a location.

6. The non-transitory computer readable storage medium of claim 5, wherein the instructions to modify comprise suppressing an alarm that is generated in response to the detecting.

7. The non-transitory computer readable storage medium of claim 5, wherein the instructions to modify comprise changing an access in an environment that is available to the robot.

8. A security system, comprising:

a sensor to detect motion of a robot;

a database to store a pre-defined motion for the robot; and an application server communicatively coupled to the sensor and the database to receive a detection signal from the sensor, to issue a challenge to the robot, perform a validation of the robot based on a comparison of a motion of the robot in response to the challenge to the pre-defined motion in the database, and modify a response of the security system based on the robot that is detected and validated, wherein modifying the response comprises removing a detection event that is generated during a detecting by the sensor from an event record, wherein the detection event includes a time, a description of the detection event, and a location.

* * * * *